US009188298B2

(12) United States Patent
Ohno

(10) Patent No.: US 9,188,298 B2
(45) Date of Patent: Nov. 17, 2015

(54) VEHICLE LIGHTING UNIT

(75) Inventor: Masafumi Ohno, Tokyo (JP)

(73) Assignee: Stanley Electric Co., Ltd., Tokyo (JP)

( * ) Notice: Subject to any disclaimer, the term of this patent is extended or adjusted under 35 U.S.C. 154(b) by 558 days.

(21) Appl. No.: 13/430,669

(22) Filed: Mar. 26, 2012

(65) Prior Publication Data

US 2012/0243249 A1 Sep. 27, 2012

(30) Foreign Application Priority Data

Mar. 25, 2011 (JP) ..... 2011-068270

(51) Int. Cl.
*F21V 5/00* (2015.01)
*F21S 8/10* (2006.01)

(52) U.S. Cl.
CPC ..... *F21S 48/1241* (2013.01); *F21S 48/1159* (2013.01); *F21S 48/1329* (2013.01); *F21S 48/1388* (2013.01)

(58) Field of Classification Search
CPC . F21S 48/1225; F21S 48/225; F21S 48/2225; F21S 48/236
USPC ..... 362/516–518, 520–522
See application file for complete search history.

(56) References Cited

U.S. PATENT DOCUMENTS

| | | | | |
|---|---|---|---|---|
| 1,421,506 | A * | 7/1922 | Limpert | 362/291 |
| 4,510,560 | A * | 4/1985 | Negishi | 362/299 |
| 5,165,772 | A * | 11/1992 | Wu | 362/26 |
| 5,276,592 | A * | 1/1994 | Henkes | 362/517 |
| 6,554,455 | B2 * | 4/2003 | Perlo et al. | 362/297 |
| 6,623,132 | B2 * | 9/2003 | Lekson et al. | 362/600 |
| 7,070,312 | B2 | 7/2006 | Tatsukawa | |
| 7,513,654 | B2 * | 4/2009 | Okada | 362/297 |
| 7,585,096 | B2 * | 9/2009 | Fallahi et al. | 362/517 |
| 2004/0257826 | A1 | 12/2004 | Tatsukawa | |
| 2005/0141227 | A1 | 6/2005 | Tsukamoto et al. | |
| 2005/0162857 | A1 | 7/2005 | Tsukamoto | |
| 2007/0070643 | A1 * | 3/2007 | Lampen et al. | 362/517 |
| 2009/0185389 | A1 * | 7/2009 | Tessnow et al. | 362/516 |
| 2009/0284980 | A1 * | 11/2009 | Iwasaki | 362/517 |

(Continued)

FOREIGN PATENT DOCUMENTS

| | | | |
|---|---|---|---|
| JP | 2005-11704 | A | 1/2005 |
| JP | 2007-250233 | A | 9/2007 |
| JP | 4108597 | B2 | 6/2008 |

(Continued)

OTHER PUBLICATIONS

List of Potentially Related Pending Applications citing U.S. Appl. No. 13/113,824 to Masafumi Ohno filed May 23, 2011.

*Primary Examiner* — Robert May
*Assistant Examiner* — Bryon T Gyllstrom
(74) *Attorney, Agent, or Firm* — Kenealy Vaidya LLP

(57) ABSTRACT

A vehicle lighting unit can include a solid light guide having a light exiting surface, a reflection surface opposite to the light exiting surface, and a light incident surface through which light enters the light guide so that the light reaches and is internally reflected off the light exiting surface, then is internally reflected off the reflection surface, and exits through the light exiting surface. An LED light source can be disposed to face towards the light incident surface. The reflection surface can include a plurality of divided reflection regions, and the reflection regions can include at least one reflection region disposed at a reference position and at least one reflection region disposed at a position closer to the light exiting surface than the reference position.

25 Claims, 17 Drawing Sheets

(56) References Cited

U.S. PATENT DOCUMENTS

| | | | | |
|---|---|---|---|---|
| 2010/0066249 | A1* | 3/2010 | Nagafuchi et al. | 315/77 |
| 2011/0286229 | A1 | 11/2011 | Ohno | |

FOREIGN PATENT DOCUMENTS

| | | | |
|---|---|---|---|
| JP | 4113111 | B2 | 7/2008 |
| JP | 4339028 | B2 | 10/2009 |

* cited by examiner

Fig. 6A
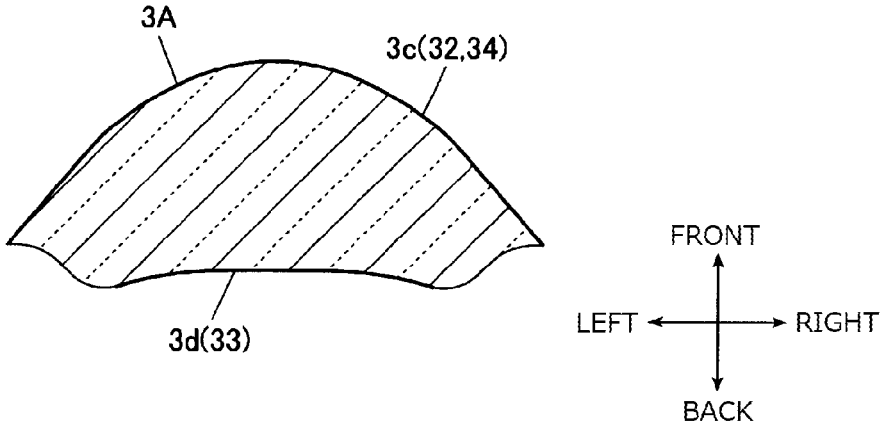
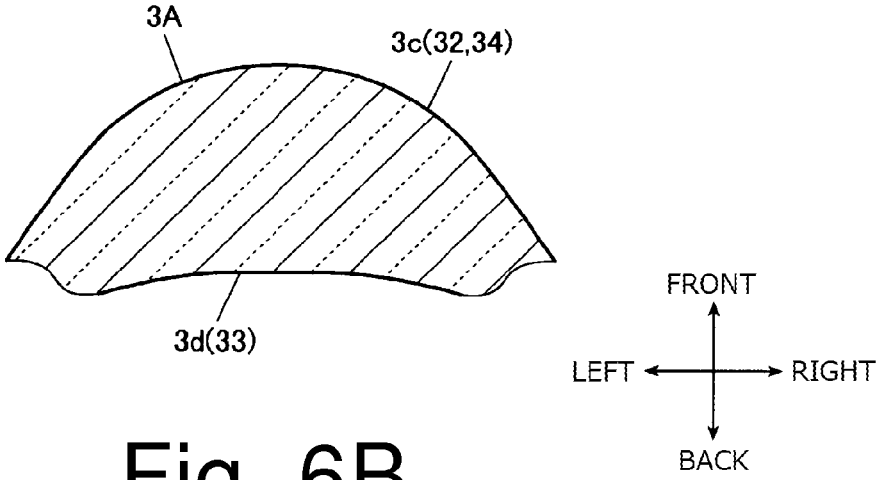
Fig. 6B

VEHICLE LIGHTING UNIT

This application claims the priority benefit under 35 U.S.C. §119 of Japanese Patent Application No. 2011-068270 filed on Mar. 25, 2011, which is hereby incorporated in its entirety by reference.

TECHNICAL FIELD

The presently disclosed subject matter relates to a vehicle lighting unit, and in particular to a vehicle lighting unit including a light guide and an LED light source in combination.

BACKGROUND ART

Conventionally, there have been various lighting units proposed including a light guide and an LED light source in the technical field of vehicular lighting units (for example, see Japanese Patent No. 4339028 or U.S. Pat. No. 7,070,312 correspond to the JP patent).

FIG. 1 shows a lighting unit 90 described in Japanese Patent No. 4339028, which can include a transparent resin light guide 91 and an LED light source 92.

The light guide 91 can be configured such that light emitted from the LED light source 92 can enter the inside of the light guide 91, be reflected off the front surface 91*a* and reflected off the rear surface 91*b*, thereby being projected forward from the front surface 91*a*.

The lighting unit 90 has the front surface 91*a* of the light guide 91 being a plane surface and the rear surface 91*b* opposite thereto being a continuous surface (for example, revolved paraboloid), and accordingly, the thickness between the front and rear surfaces 91*a* and 91*b* becomes large. This may increase the molding time for the light guide 91 and the amount of a transparent resin material, thereby resulting in cost increase. In general, the molding time for a molded article may be proportional to the square of the thickness of the molded article.

In addition, when the thickness is large, shrinkage or the like giving adverse effects on the accuracy of the light guide 91 (by extension, light distribution) may be likely to occur. There may be another problem due the large thickness (namely, the optical path length in the light guide 91 may be longer) wherein the light entering the light guide may be likely to be affected by the absorption of the transparent resin material or haze (volume scattering). In order to reduce such adverse effects like the absorption of the transparent resin material or haze (volume scattering), it has been a consideration to shorten the optical path length in the light guide 91. However, this has been achieved by miniaturization of the entire size of the light guide 91, resulting in decrease of the light utilization efficiency and the like.

Further, the lighting unit 90 as described above may have a problem of lower degree of freedom with regard to the formation of light distribution because the rear surface 91*b* of the light guide 91 is a continuous surface (revolved paraboloid, for example). In order to cope with this problem, a plurality of lighting units 90 each forming different light distribution are combined to synthesize a desired light distribution pattern as disclosed in the above patent literature.

SUMMARY

The presently disclosed subject matter was devised in view of these and other problems and features and in association with the conventional art. According to an aspect of the presently disclosed subject matter, a vehicle lighting unit can include a light guide thinner than the conventional one.

According to another aspect of the presently disclosed subject matter, a vehicle lighting unit can improve the degree of freedom to form light distribution.

According to still another aspect of the presently disclosed subject matter, a vehicle lighting unit can include: a solid light guide having a light exiting surface, a reflection surface opposite to the light exiting surface, and a light incident surface through which light enters the light guide so that the light reaches and is internally reflected off the light exiting surface, then internally reflected off the reflection surface, and exits through the light exiting surface; and an LED light source disposed to face forward and obliquely downward to the light incident surface, for emitting light that enters the light guide through the light incident surface, is internally reflected off the light exiting surface, is internally reflected off the reflection surface, and exits through the light exiting surface as light parallel to the optical axis.

According to still further another aspect of the presently disclosed subject matter, a vehicle lighting unit can include a solid light guide having a light exiting surface, a reflection surface opposite to the light exiting surface, and a light incident surface through which light enters the light guide so that the light reaches and is internally reflected off the light exiting surface, then internally reflected off the reflection surface, and exits through the light exiting surface; and an LED light source disposed to face to the light incident surface, for emitting light that enters the light guide through the light incident surface, is internally reflected off the light exiting surface, is internally reflected off the reflection surface, and exits through the light exiting surface. The reflection surface can include a plurality of divided reflection regions. The reflection regions can include at least one reflection region disposed at a reference position and at least one reflection region disposed at a position closer to the light exiting surface than the reference position.

With the above configuration, since the certain reflection region can be disposed (shifted) at the position closer to the light exiting surface than the reference position, the thickness of the light guide can be thinned by that amount corresponding to the shift.

Further, since the thinning of the thickness of the light guide can be achieved with ease, the molding time for the light guide and the amount of a transparent resin material used for the light guide can be reduced, thereby suppressing cost.

In addition, since the thinning of the thickness of the light guide can be achieved with ease, the shrinkage or the like that may adversely affect the accuracy of the light guide (light distribution by extension) can be prevented from occurring.

Furthermore, since the thinning of the thickness of the light guide can be achieved with ease, i.e., the optical path length in the light guide can be shortened, the adverse effects due to the absorption of the transparent resin material or haze (volume scattering) can be suppressed.

Accordingly, with the above configuration, a vehicle lighting unit with a thinner light guide as compared to the conventional ones can be provided.

Further, since the certain reflection region(s) out of the plurality of divided reflection regions can be shifted closer to the light exiting surface, the vehicle lighting unit with a novel appearance wherein a step can be observed between the reflection regions can be provided.

According to another aspect of the presently disclosed subject matter, a vehicle lighting unit can include a solid light guide having a light exiting surface, a reflection surface opposite to the light exiting surface, and a light incident surface through which light enters the light guide so that the light reaches and is internally reflected off the reflection surface, and exits through the light exiting surface; and an LED light source disposed to face to the light incident surface, for emitting light that enters the light guide through the light incident surface, is internally reflected off the reflection surface, and exits through the light exiting surface. The reflection surface can include a plurality of divided reflection regions. The reflection regions can include at least one reflection region disposed at a reference position and at least one reflection region disposed at a position closer to the light exiting surface than the reference position.

With the above configuration, since the certain reflection region out of the plurality of reflection regions can be disposed (shifted) at the position closer to the light exiting surface than the reference position, the thickness of the light guide can be thinned by that amount corresponding to the shift.

Further, since the thinning of the thickness of the light guide can be achieved with ease, the molding time for the light guide and the amount of a transparent resin material used for the light guide can be reduced, thereby suppressing cost.

In addition, since the thinning of the thickness of the light guide can be achieved with ease, the shrinkage or the like that may adversely affect the accuracy of the light guide (light distribution by extension) can be prevented from occurring.

Furthermore, since the thinning of the thickness of the light guide can be achieved with ease, i.e., the optical path length in the light guide can be shortened, the adverse effects due to the absorption of the transparent resin material or haze (volume scattering) can be suppressed.

Accordingly, with the above configuration, a vehicle lighting unit with a thinner light guide as compared to the conventional ones can be provided.

Further, since the certain reflection region(s) out of the plurality of divided reflection regions can be shifted closer to the light exiting surface, the vehicle lighting unit with a novel appearance wherein a step can be observed between the reflection regions can be provided.

In the vehicle lighting unit with any of the above configurations, the reflection surface can be divided into the plurality of reflection regions by at least one horizontal plane.

If the certain reflection region out of the plurality of reflection regions divided by the at least one horizontal plane is disposed at a position shifted closer to the light exiting surface, the light guide can be thinned by that amount (corresponding to the shift amount).

In the vehicle lighting unit with any of the above configurations, the reflection surface can be divided into the plurality of reflection regions by at least one vertical plane.

If the certain reflection region out of the plurality of reflection regions divided by the at least one vertical plane is disposed at a position shifted closer to the light exiting surface, the light guide can be thinned by that amount (corresponding to the shift amount).

In the vehicle lighting unit with any of the above configurations, the reflection surface can be divided into the plurality of reflection surface regions by at least two vertical planes, and the reflection regions between the two vertical planes can be disposed at positions shifted closer to the light exiting surface than the adjacent reflection regions on both sides.

If the certain reflection region out of the plurality of reflection regions divided by the at least two vertical planes and positioned between the at least two vertical planes is disposed at a position shifted closer to the light exiting surface, the light guide can be thinned by that amount (corresponding to the shift amount).

In the vehicle lighting unit with any of the above configurations, the plurality of reflection regions can be disposed at a position shifted closer to the light exiting surface as the reflection region is closer to the light incident surface.

Since the reflection region can be disposed at a position shifted closer to the light exiting surface as the reflection region is closer to light incident surface, the light internally reflected can be prevented from entering a step appearing between the adjacent reflection regions.

In the vehicle lighting unit with any of the above configurations, the plurality of reflection regions each can form a light distribution pattern part constituting a desired light distribution pattern formed by the light projected through the light exiting surface.

With this configuration, when compared with a conventional case in which the reflection surface is a continuous surface (revolved paraboloid), the reflection surface is divided into the plurality of reflection regions each capable of forming a particular light distribution pattern part. This can give a higher degree of freedom for forming the light distribution for the vehicle lighting unit.

According to an aspect of the presently disclosed subject matter, there can be provided a vehicle lighting unit that includes a light guide thinner than the conventional one. In addition, there can be provided a vehicle lighting unit that improves the degree of freedom for forming light distribution.

BRIEF DESCRIPTION OF DRAWINGS

These and other characteristics, features, and advantages of the presently disclosed subject matter will become clear from the following description with reference to the accompanying drawings, wherein:

FIGS. 6A and 6B are cross-sectional views taken along line II-II and line III-III in FIG. 5, respectively;

DESCRIPTION OF EXEMPLARY EMBODIMENTS

A description will now be made below to vehicle lighting units of the presently disclosed subject matter with reference to the accompanying drawings in accordance with exemplary embodiments.

A vehicle lighting unit 1 of the present exemplary embodiment can constitute a vehicle headlamp to be installed on the right and left sides of the vehicle front body.

Figure 1:
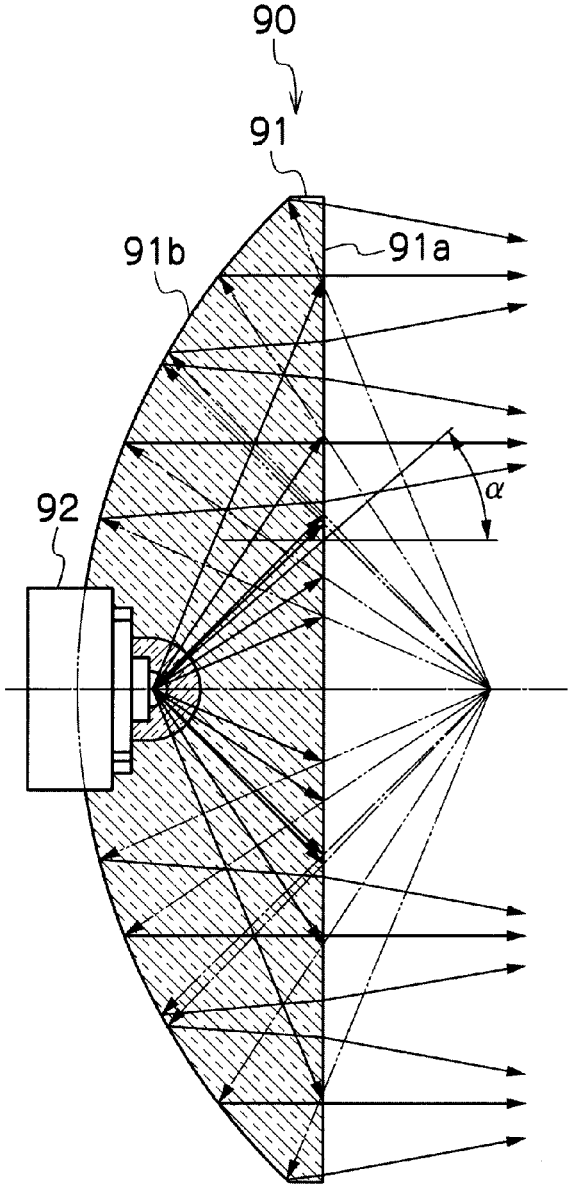
Fig. 1 Conventional Art
FIG. 1 is a cross-sectional view of a conventional example.
Figure 2A:
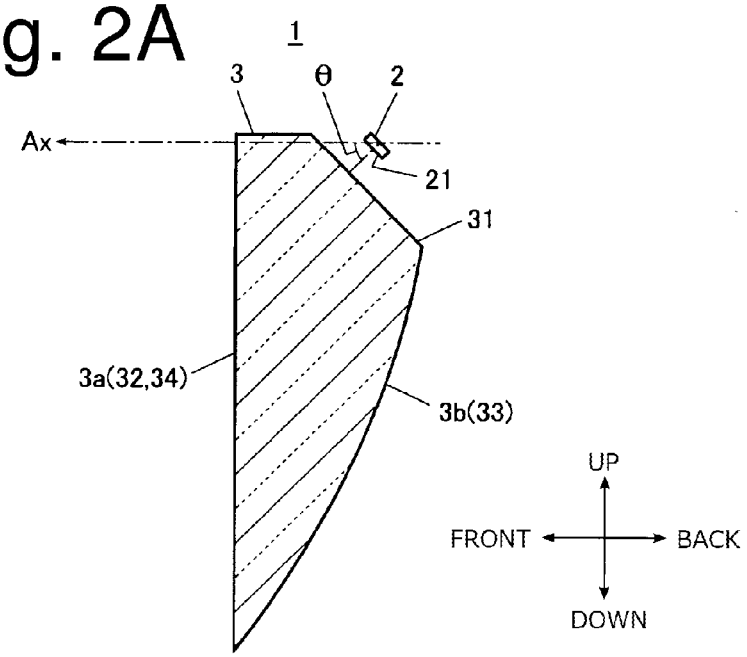
FIGS. 2A and 2B are a cross-sectional side view and a plan view of a vehicle lighting unit of one exemplary embodiment made in accordance with principles of the presently disclosed subject matter, respectively.
Figure 2B:
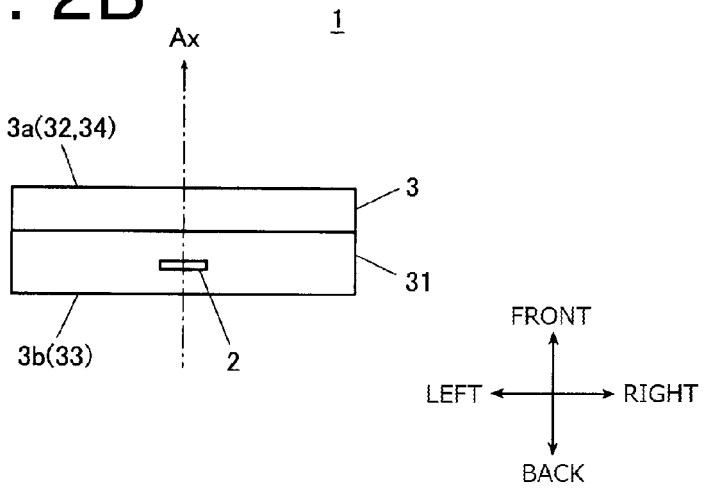

FIGS. 2A and 2B are a cross-sectional side view and a plan view of the vehicle lighting unit 1 of the present exemplary embodiment, respectively.

As shown in these drawings, the vehicle lighting unit 1 can include a light source 2 and a light guide 3 so as to project light along an optical axis Ax (extending in the front to rear direction of a vehicle body) forward.

The light source 2 can be a white LED light source including a blue LED chip and a phosphor in combination, for example. The light source 2 can be disposed such that the light source 2 can emit light in a direction inclined with respect to the optical axis Ax. Specifically, the light source 2 (light emission surface 21) can be directed along and evenly about a center emission axis forward and obliquely downward such that the angle θ formed between the center emission axis of the light emission direction of the light source and the optical axis Ax in the vertical cross-section can be 45 degrees±10 degrees.

The light guide 3 can be a light-transmitting member disposed forward and obliquely downward with respect to the light source 2. The light guide 3 can be configured to receive light from the light source 2 to project the light having become parallel to the optical axis Ax as a result of light guiding.

The light guide 3 can have a light incident surface 31 at its upper rear portion, the light incident surface 31 capable of receiving light therethrough from the light source 2. The light incident surface 31 can be opposite to the light emission surface 21 of the light source 2 with a certain gap and parallel to the light emission surface 21, namely, be inclined by an angle of 45 degrees±10 degrees with respect to the optical axis Ax in the vertical cross-section as shown in the drawing.

The light guide 3 can further have a light exiting surface 34 on its front surface 3*a*. The light exiting surface 34 can be a plane extending along the vertical and horizontal directions. The light exiting surface 34 can serve as a first reflection surface 32 (inner surface) for internally reflecting the light entering through the light incident surface 31 rearward.

The light guide 3 can further have a second reflection surface 33 on its rear surface 3*b*. The second reflection surface 33 can be a curved surface toward the lower end of the front surface 3*a* and be configured to internally reflect the light having internally reflected by the first reflection surface 32 toward the light exiting surface 34 while converting it to parallel light along and about the optical axis Ax.

Accordingly, the light guide 3 can be a solid light guide lens including the light incident surface 31 for receiving light from the light source 2, the light exiting surface 34 serving also as the first reflection surface 32 for reflecting the light rearward, and the second reflection surface opposite to the light exiting surface 34 while being inclined with respect to the light exiting surface 34. The light entering the light guide 3 through the light incident surface 31 can be internally reflected off the first reflection surface 32 at the light exiting surface 34 rearward and can travel to the second reflection surface 33, and then can be internally reflected off the second reflection surface 34 to be parallel to each other, and finally can exit through the light exiting surface 34. The light guide 3 can be formed by injection molding a transparent resin material such as an acrylic resin, a polycarbonate, a cycloolefine polymer, and the like.

Here, a description will be given of how to determine the rear surface 3*b* or the second reflection surface 33 of the light guide 3 while describing the vertical cross sectional shape.

Figure 3A:
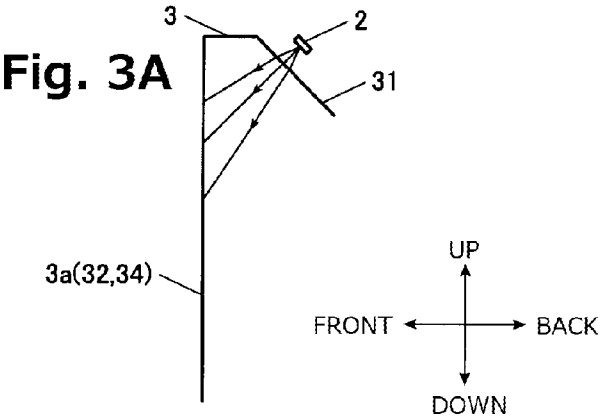
FIGS. 3A to 3D are diagrams illustrating how to determine the rear surface shape of a light guide in the exemplary embodiment.

First, as shown in FIG. 3A, assume that the light emitted from the light source 2 within a predetermined range can enter the light guide 3. In this case, while taking the refraction at the light incident surface 31 into consideration, the light rays are traced up to the front surface 3*a* of the light guide 3.

Figure 3B:
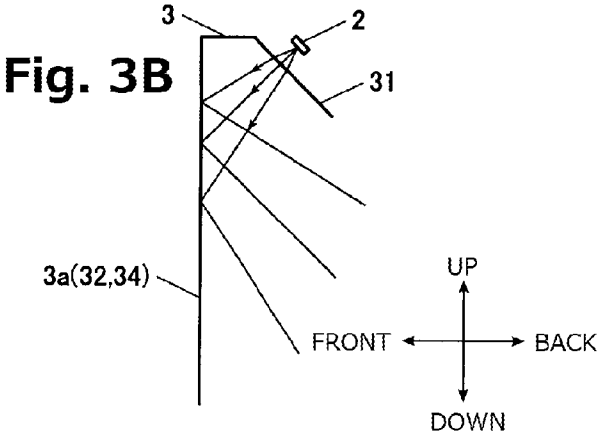

Next, as shown in FIG. 3B, assume that the light rays are totally reflected off the front surface 3*a* or the first reflection surface 32 of the light guide 3, and the light rays are traced.

Figure 3C:
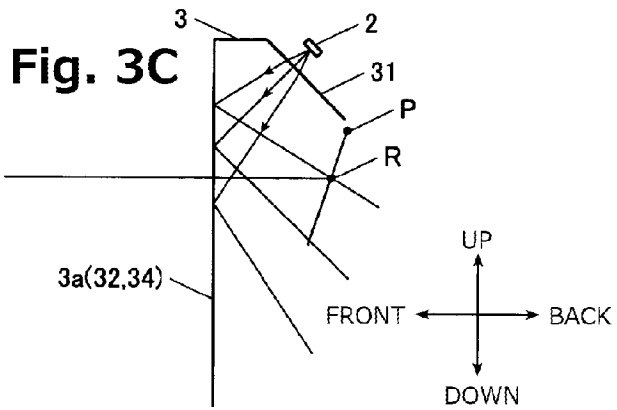

Then, as shown in FIG. 3C, assume that a predetermined starting point P is defined on the rear surface of the light guide 3. In this case, the inclined angle at the reflection point R can be determined so that the top traced light ray can be totally reflected at that point forward in parallel to the optical axis Ax.

Next, the inclined angle at the next reflection point, that is positioned on the straight line as determined by the inclined angle at the reflection point R and crossing the second top traced light ray, can be determined so that the second top traced light ray can be totally reflected at the point forward in parallel to the optical axis Ax.

Figure 3D:
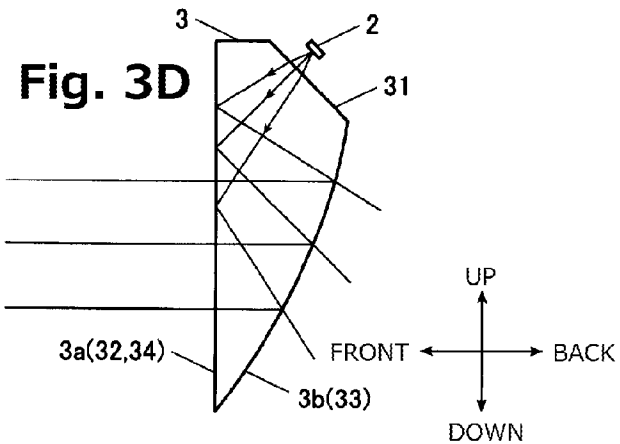

In the same manner, as shown in FIG. 3D, all the inclined angles and the crossing points (reflection points) of light rays can be sequentially determined, and these points can be connected sequentially from the light incident surface 31 to the lower end of the front surface 3*a* by a continuous curve or a spline curve.

In this manner, the rear surface 3*b* in the vertical cross-sectional shape can be determined with respect to the front-to-rear direction. Note that the light guide 3 of the present exemplary embodiment can have the rear surface 3*b* extending in the horizontal direction, and accordingly, any vertical cross-section along the front-to-rear direction can satisfy the same light guiding conditions if the light rays as shown in FIG. 3B enter the light guide 3.

In the vehicle lighting unit 1 with the above configuration, the light can be emitted from the light source 3 forward and obliquely downward with respect to the optical axis Ax and enter the light guide 3 through the light incident surface 31. The light can be internally reflected off the front surface 3*a* or the first reflection surface 32 of the light guide 3 rearward, and again be internally reflected off the rear surface 3*b* or the second reflection surface 33 forward while becoming parallel to the optical axis Ax, and then be projected through the front surface 3*a* or the light exiting surface 34 of the light guide 3. Accordingly, the vehicle lighting unit 1 can provide parallel light along the optical axis Ax.

As described, in the vehicle lighting unit 1 of the present exemplary embodiment, since the light source 2 can emit light forward and obliquely downward with respect to the optical axis Ax, there is no need to dispose a light guide in front of the light source while the light guide extends in the vertical direction as in the conventional vehicle lighting unit in which a light source emits light forward. In the present exemplary embodiment, the light guide 3 can be disposed forward and obliquely downward with respect to the light source 2, and accordingly, the light from the light source 2 can be efficiently taken in the light guide 3. In addition, when compared with the conventional vehicle lighting unit, the light guide can be configured with a compact vertical dimension.

As a result, the thickness variation of the light guide 3 can be smaller than in the conventional ones, thereby improving the molding accuracy of the light guide 3. By extension, the molding cost can be reduced.

The light that has entered the light guide 3 can be internally reflected off the first reflection surface 32 rearward, and again be internally reflected off the second reflection surface 33 forward while becoming parallel to the optical axis Ax, and then be projected through the light exiting surface 34 of the light guide 3. Namely, the light guide 3 can internally reflect the light twice in the front or rear direction before exiting through the light exiting surface 34. The conventional light guide can internally reflect light once. Accordingly, the light guide 3 can be configured with compact dimension in the front-to-rear direction.

Further, since the light incident surface 31 of the light guide 3 can face towards the light source 2 with a certain gap therebetween, the effect of the heat generated from the light source 2 to the light guide 3 can be reduced when compared with the conventional case wherein the light source is in contact with the light guide.

<Modification 1>

Next, a description will be given of a modification 1 of the present exemplary embodiment. Note that the same as or similar components to the above exemplary embodiment are denoted by the same reference numerals, and a redundant description therefor will be omitted here.

Figure 5:
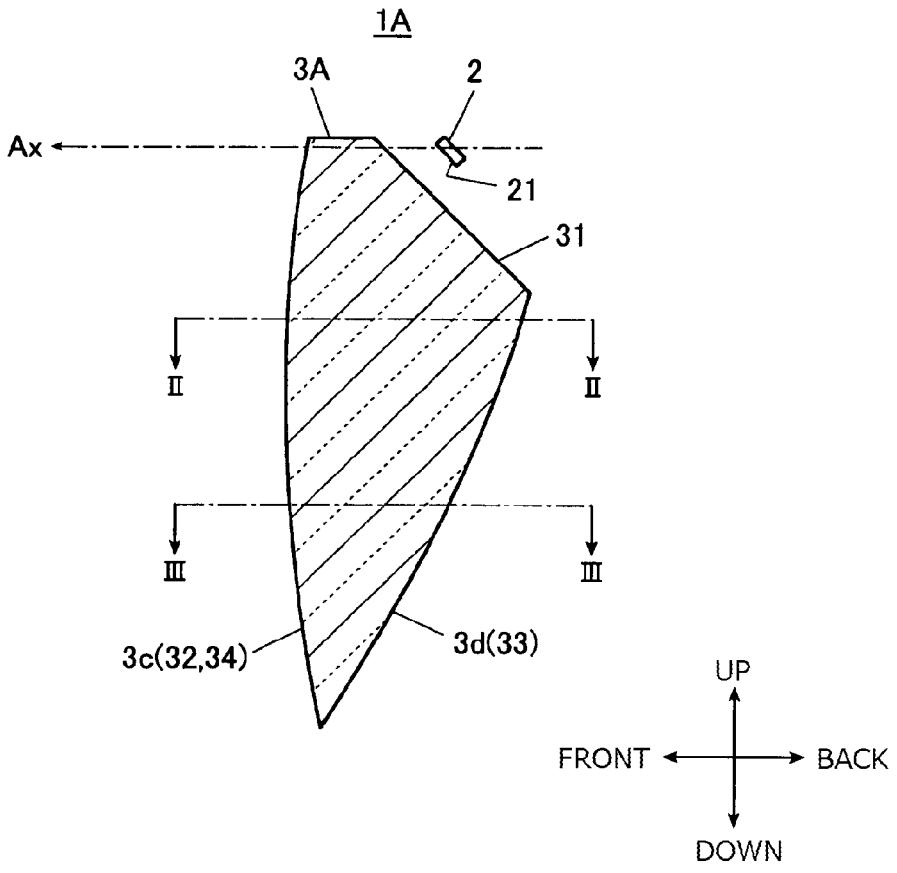
FIG. 5 is a schematic cross-sectional side view of a vehicle lighting unit of a modification of the present exemplary embodiment.

FIG. 5 is a schematic cross-sectional side view of a vehicle lighting unit 1A of the present modification, and FIGS. 6A and 6B are cross-sectional views taken along line II-II and line III-III in FIG. 5, respectively.

As shown in the drawings, the vehicle lighting unit 1A can include a light guide 3A in place of the light guide 3 of the above exemplary embodiment.

The light guide 3A can have a curved front surface 3*c* curved in the vertical direction and horizontal direction, rather than the flat front surface 3*a*. In response to the curved front surface 3*c*, the light guide 3A should have a rear surface 3*d* differently curved from the rear surface 3*b* of the above exemplary embodiment.

Here, a description will be given of how to determine the rear surface 3*d* or the second reflection surface 33 of the light guide 3A while describing the vertical cross sectional shape.

Figure 7A:
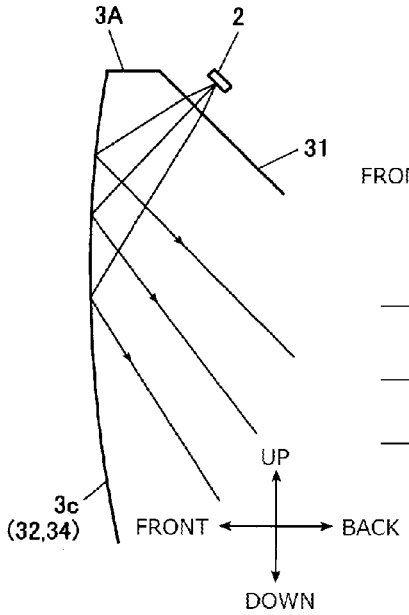
FIGS. 7A, 7B, and 7C are diagrams illustrating how to determine the rear surface shape of a light guide in the modification of the exemplary embodiment.

First, as shown in FIG. 7A, assume that the light emitted from the light source 2 within a predetermined range can enter the light guide 3A. In this case, while taking the refraction at the light incident surface 31 into consideration, the light rays are traced up to the front surface 3*c* of the light guide 3A. Further, assume that the light rays are totally reflected off the front surface 3*c* or the first reflection surface 32 of the light guide 3A, and the light rays are traced.

Figure 7B:
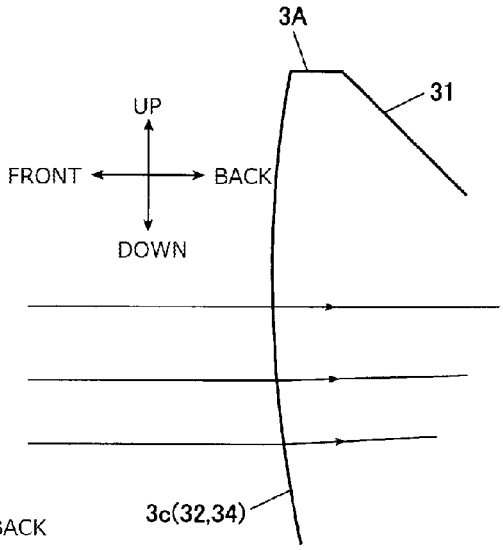

Then, as shown in FIG. 7B, while taking the refraction at the front surface 3*c* (or the light exiting surface 34), the parallel light rays to be emitted through the front surface 3*c* are traced reversely up to the rear side of the light guide 3A.

Next, as shown in FIG. 6C, the crossing points between the light rays traced from the light source 2 and the light rays reversely traced from the front surface 3*c* are obtained. Then, the inclined angles at respective crossing points are determined so that the light rays are totally reflected at the respective crossing points (reflection points).

All the inclined angles and the crossing points (reflection points) of light rays can be sequentially determined, and these points can be connected sequentially from the light incident surface 31 to the lower end of the front surface 3*c* by a continuous curve or a spline curve.

In this manner, the rear surface 3*d* in the vertical cross-sectional shape can be determined with respect to the front-to-rear direction.

Figure 7C:
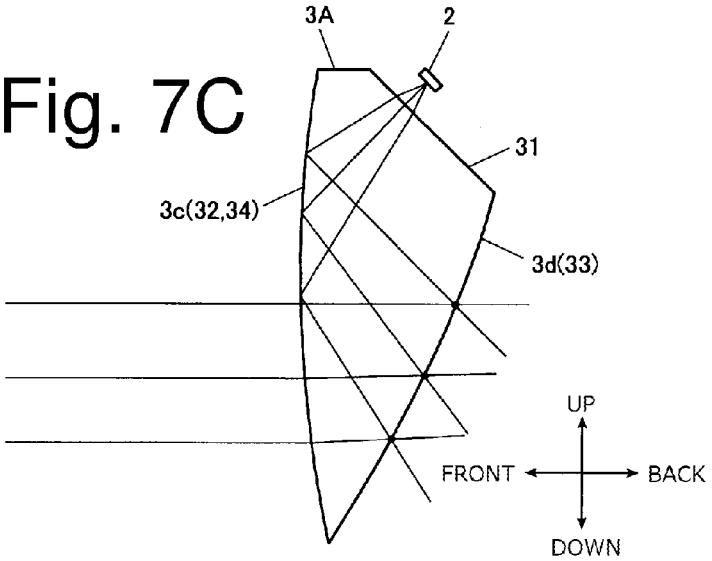
Figure 8A:
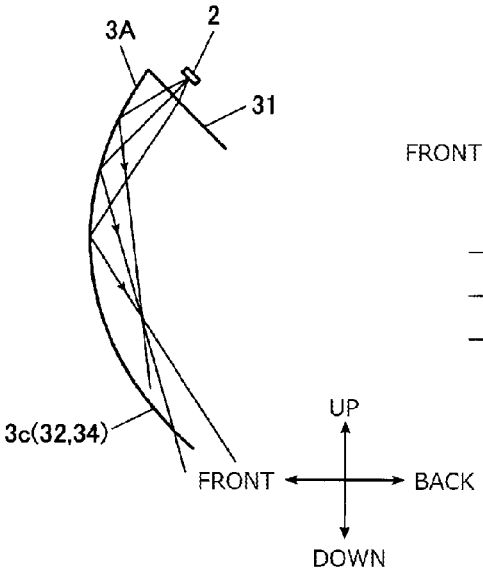
FIGS. 8A, 8B, and 8C are diagrams illustrating the states where the rear surface conditions of the light guide are not met in the modification of the exemplary embodiment.
Figure 8B:
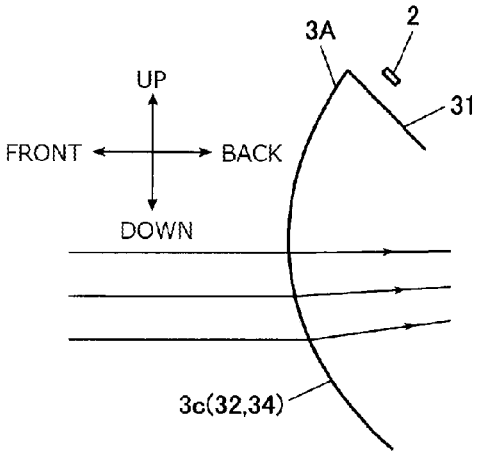
Figure 8C:
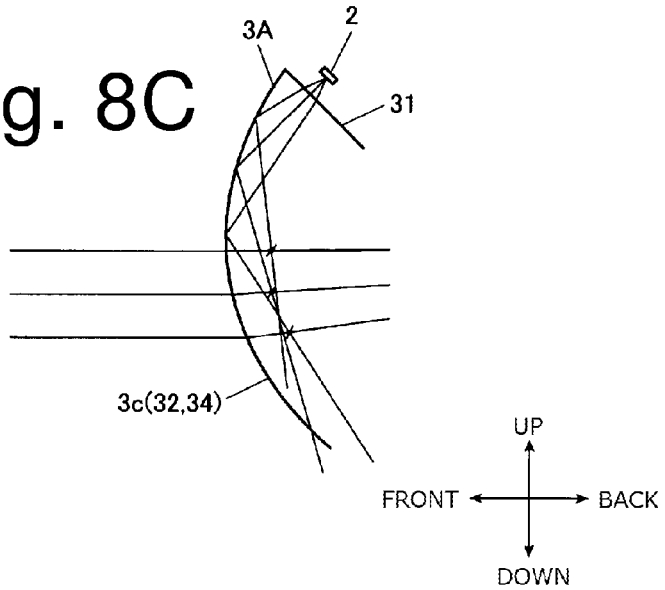

Note that if the curvature of the front surface 3*c* is excessively large and, as shown in FIG. 7A, the adjacent traced light rays (assumed light rays) cross with each other, the rear surface 3*d* cannot be designed. Namely, in this case, even when the respective reverse-traced light rays from the front surface 3*c* do not cross with each other as shown in FIG. 7B, there would be a case where the respective crossing points cannot be connected with a spline curve while the inclination angles at respective crossing points satisfy the conditions of total reflection as shown in FIG. 7C. Accordingly, in order to satisfy the conditions of total reflection at the rear surface 3*d*, it is necessary for the respective adjacent light rays to reach the rear surface 3*d* with wider angles rather than parallel to each other. Thus, the front surface 3*c* must satisfy these conditions. Off course, when the light incident surface 31 is curved, the light incident surface 31 must satisfy the same conditions.

The vehicle lighting unit 1A with the above configuration can provide the same advantageous effects as those of the vehicle lighting units 1 of the above exemplary embodiment.

<Modification 2>

Next, a description will be given of a modification 2 of the present exemplary embodiment.

Figure 11:
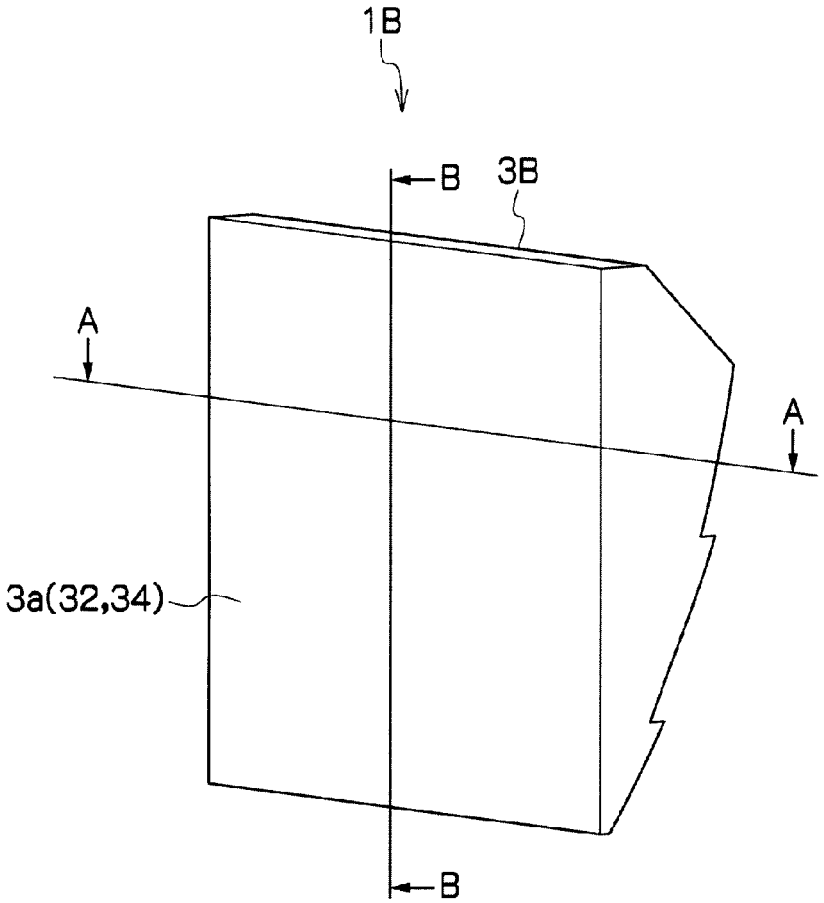
FIG. 11 is a perspective view illustrating a vehicle lighting unit as a modification 2.
Figure 12A:
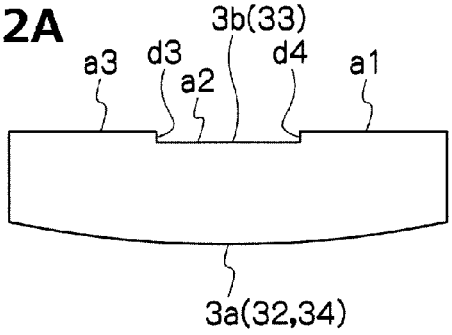
FIGS. 12A, 12B, and 12C are a cross-sectional view taken along line A-A, a cross-sectional view taken along line B-B, and a perspective view when viewed from rear side, of the vehicle lighting unit shown in FIG. 11, respectively.
Figure 12B:
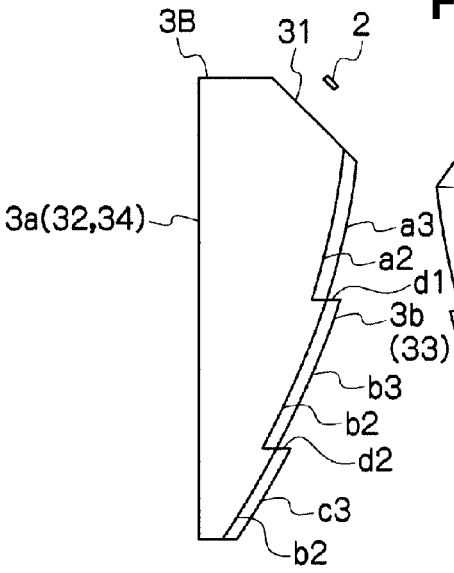
Figure 12C:
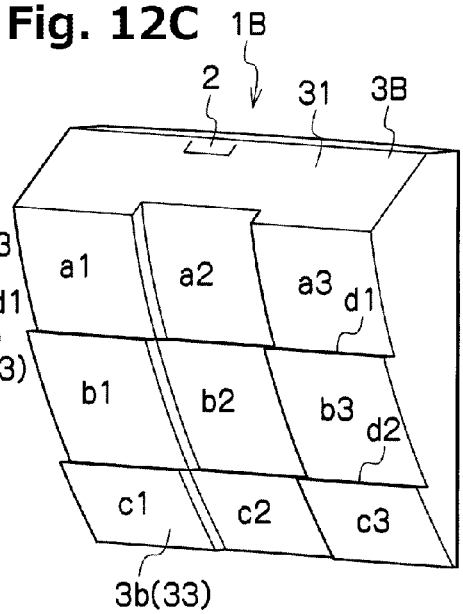

FIG. 11 is a perspective view illustrating a vehicle lighting unit 1B as a modification 2, and FIGS. 12A, 12B, and 12C are a cross-sectional view taken along line A-A, a cross-sectional view taken along line B-B, and a perspective view when viewed from rear side, of the vehicle lighting unit 1B shown in FIG. 11, respectively.

The vehicle lighting unit 1B of the modification 2 can have the same configuration as that of the above exemplary embodiment, except that the second reflection surface 33 of the light guide 3B can include a plurality of reflection regions a1 to a3, b1 to b3, and c1 to c3 divided by two horizontal planes and two vertical planes parallel to the optical axis Ax. Note that the number of the planes for dividing the surface is not limited to two, but one or three or more planes (vertical and/or horizontal planes) can be employed.

The plurality of reflection regions a1 to a3, b1 to b3, and c1 to c3 can be configured such that the reflection region can be disposed closer to the light exiting surface 34 as the reflection region is closer to the light incident surface 31. For example, as shown in FIG. 11B, the reflection regions a3, b3, and c3 can be configured such that the reflection region b3 is disposed at a position shifted closer to the light exiting surface 34 than the reflection region c3 that is disposed at the reference position as the above exemplary embodiment, and the reflection region a3 is disposed at a position shifted closer to the light exiting surface 34 than the reflection region b3. The same conditions are applied to the other rows. In this manner, the steps d1 and d2 can appear between the adjacent reflection regions.

In the modification 2, the reflection regions a2, b2, and c2 positioned between the two vertical planes can be disposed at respective positions shifted closer to the light exiting surface 34 than the adjacent reflection regions a1 to c1 and a3 to c3. For example, as shown in FIG. 11A, the reflection regions a1 to a3 can be configured such that the reflection region a2 is disposed at a position shifted closer to the light exiting surface 34 than the adjacent reflection regions a1 and a3. The same conditions are applied to the other rows. In this manner, the steps d3 and d4 can appear between the adjacent reflection regions.

Figure 13A:
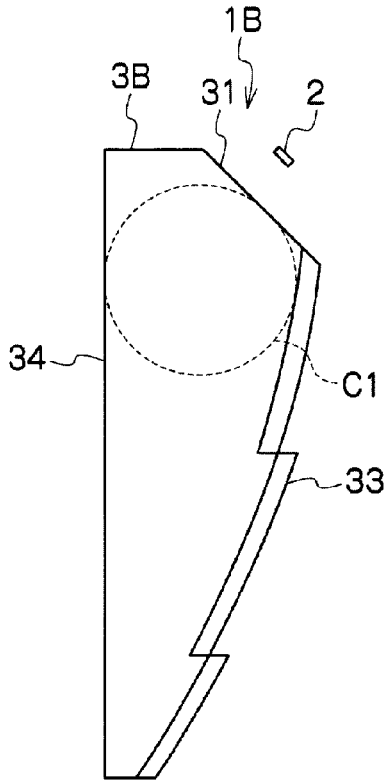
FIGS. 13A and 13B are longitudinal cross-sectional views of the vehicle lighting unit (modification 2) and the vehicle lighting unit (the exemplary embodiment), respectively.
Figure 13B:
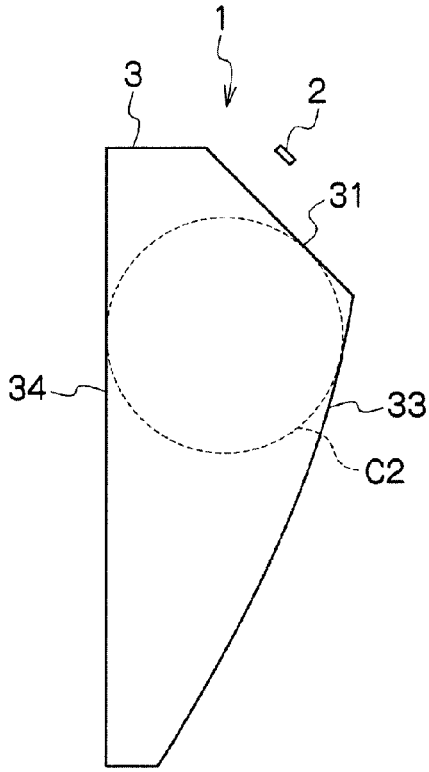

FIGS. 13A and 13B are longitudinal cross-sectional views of the vehicle lighting unit 1B (modification 2) and the vehicle lighting unit 1 (the exemplary embodiment), respectively.

As shown in these drawings, the maximum inscribed circle C1 in FIG. 13A is smaller than the inscribed circle C2 in FIG. 13B, meaning that the thickness of the light guide 3B of the modification 2 is thinner than the light guide 3 of the above exemplary embodiment. (The maximum thickness portion of the modification 2 is thinner than that of the above exemplary embodiment.)

As shown, the modification 2 can be configured such that the reflection region among the plurality of divide reflection regions a1 to a3, b1 to b3, and c1 to c3 can be disposed at a position shifted closer to the light exiting surface 34 with reference to the reference position as the reflection region is closer to the light incident surface 31. Further, the reflection regions a2, b2, and c2 between the two vertical planes can be disposed at respective positions shifted closer to the light exiting surface 34. In this manner, the thickness of the light guide 3 can be thinned more. Accordingly, the molding time for the light guide 3B can be optimized.

Further, since the thinning of the thickness of the light guide 3B can be achieved in the modification 2, the molding time for the light guide 3B and the amount of a transparent resin material used for the light guide 3B can be reduced, thereby suppressing cost.

In addition, since the thinning of the thickness of the light guide 3B can be achieved with ease in the modification 2, the shrinkage or the like that may adversely affect the accuracy of the light guide 3B (light distribution by extension) can be prevented from occurring. This can improve the accuracy of the light guide 3B, and also light distribution by extension, thereby suppressing the generation of unintended unnecessary light.

Figure 4A:
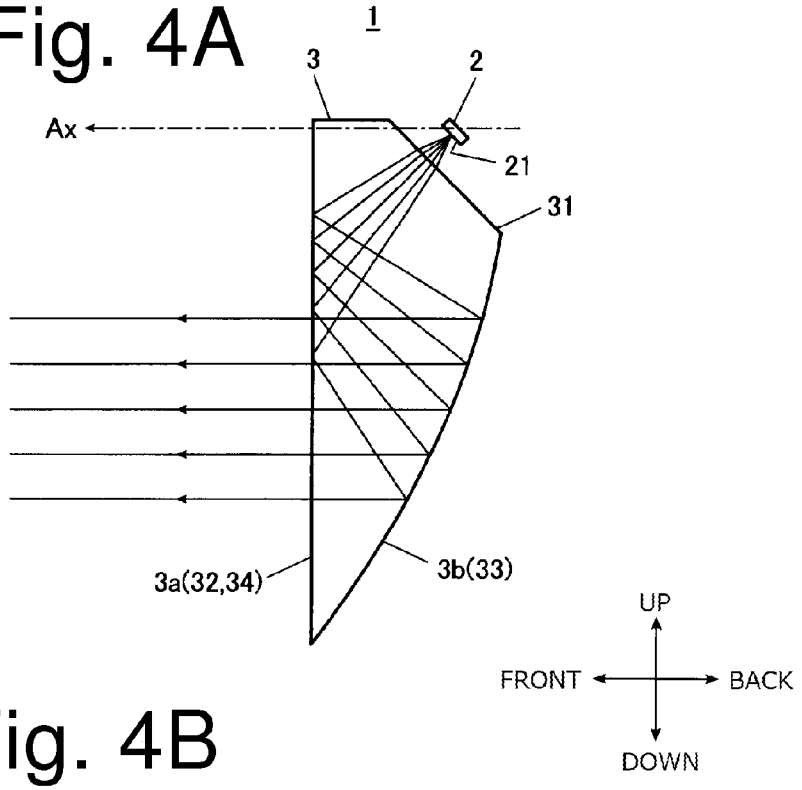
FIGS. 4A and 4B are a schematic cross-sectional side view and a plan view of a vehicle lighting unit in the exemplary embodiment, illustrating the light emission state, respectively.
Figure 4B:
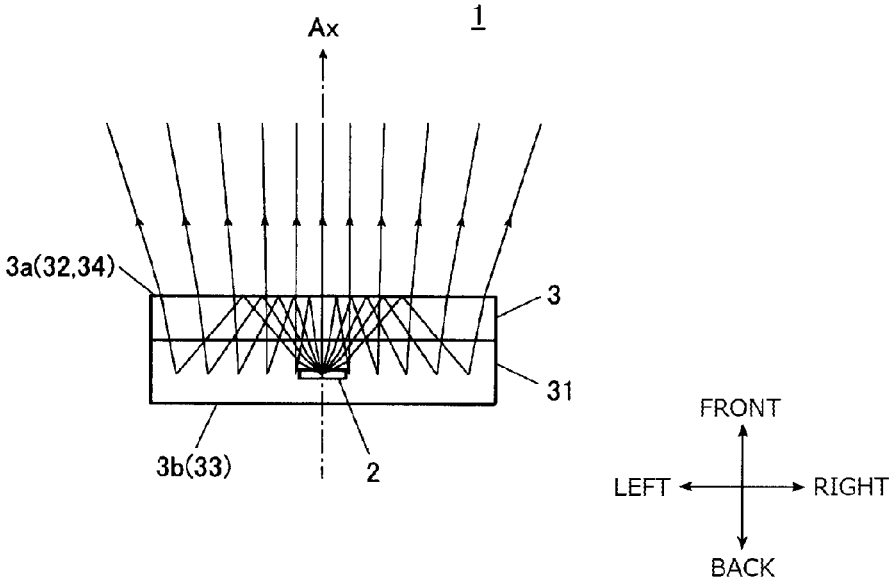
Figure 14:
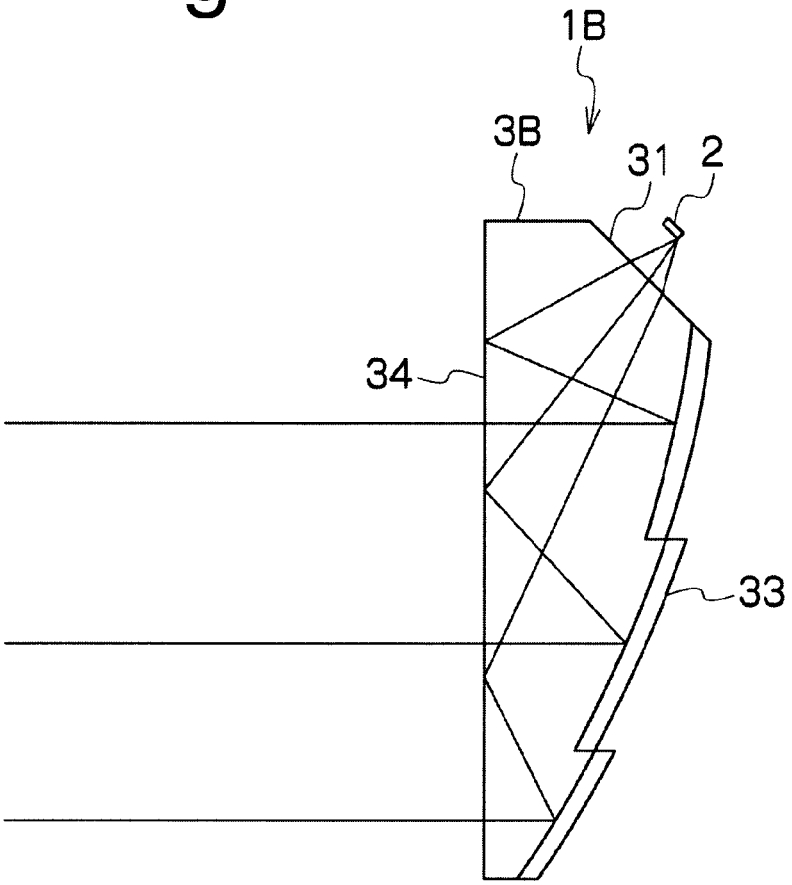
FIG. 14 is a longitudinal cross-sectional view (including optical paths) of the vehicle lighting unit (modification 2)

Further, in the modification 2 as shown in FIG. 14, the light from the light source 2 can enter the light guide 3B and exit through the light exiting surface 34 through the similar optical paths as shown in FIG. 4A. By thinning the thickness of the light guide 3B, the optical path length in the light guide 3B may be shortened. Since the thinning of the thickness of the light guide 3B can be achieved with ease in the modification 2, i.e., the optical path length in the light guide 3B can be shortened, the adverse effects due to the absorption of the transparent resin material for the light guide 3B or haze (volume scattering) can be suppressed. In general, the haze may cause volume scattering in a medium, lowering the definiteness at the cut-off line and possibly causing glare light. In particular, the portion near the light incident surface 31 may include a large amount of luminous fluxes, and accordingly, the effect of the shortening the optical path length at that portion may be large. Furthermore, if a polycarbonate resin that is transparent but has high light absorption characteristics, is used for the transparent resin material, the shortening of the optical path near the light incident surface 31 can suppress the lowering the luminous flux.

The attenuation of light can be represented by the following formula:

$$I=I_0 10^{-\beta x}$$

wherein β is an absorbance, x is a distance that the light passes through a medium, $I_0$ is an intensity of incident light, and I is an intensity of exiting light.

As described above, when compared with the conventional unit, the modification 2 can provide the vehicle lighting unit 1B with a thinner light guide 3B.

Since the reflection region among the reflection regions a1 to a3, b1 to b3, and c1 to c3 can be disposed at a position shifted closer to the light exiting surface 34 as the reflection region is closer to light incident surface 31, the steps d1 to d4 or the like can appear between the adjacent reflection regions as shown in FIGS. 12B and 12C. This can provide a novel appearance to the vehicle lighting unit 1B.

Since the reflection region among the reflection regions a1 to a3, b1 to b3, and c1 to c3 can be disposed at a position shifted closer to the light exiting surface 34 as the reflection region is closer to light incident surface 31, the light internally reflected off the light exiting surface 34 can be prevented from entering the step d1 or the like appearing between the adjacent reflection regions.

In the vehicle lighting unit, the plurality of reflection regions a1 to a3, b1 to b3, and c1 to c3 each can form a light distribution pattern part A1 to A3, B1 to B3, or C1 to C3 (see FIG. 15A) constituting a desired light distribution pattern (see FIG. 15B) formed by the light projected through the light exiting surface 34.

Figure 15A:
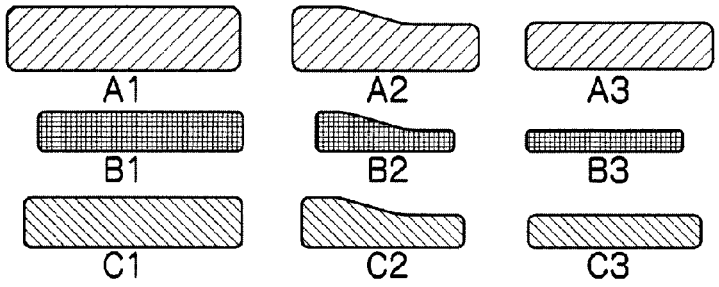
FIGS. 15A and 15B are a diagram showing light distribution pattern parts A1 to A3, B1 to B3, and C1 to C3 corresponding to individual reflection regions a1 to a3, b1 to b3, and c1 to c3, and a diagram showing the synthesized light distribution pattern synthesizing these light distribution pattern parts A1 to A3, B1 to B3, and C1 to C3, respectively.
Figure 15B:
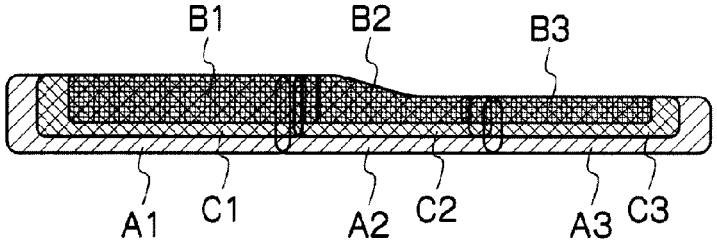

With this configuration, when compared with the conventional case in which the reflection surface is a continuous surface (revolved paraboloid), the second reflection surface 33 can be divided into the plurality of reflection regions a1 to a3, b1 to b3, and c1 to c3 each capable of forming a particular light distribution pattern part A1 to A3, B1 to B3, or C1 to C3 as shown in FIG. 15A. This can give a higher degree of freedom for forming the light distribution to the vehicle lighting unit 1B.

Figure 16A:
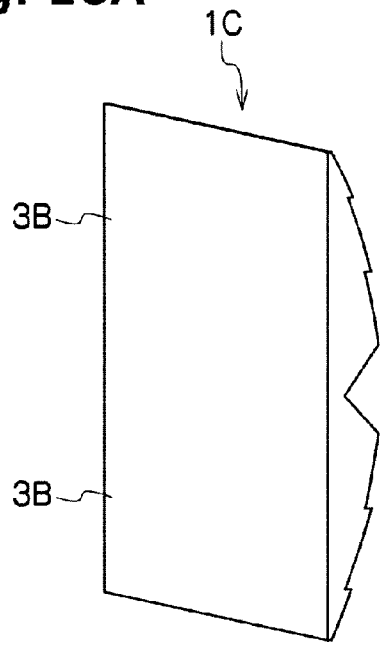
FIGS. 16A, 16B, and 16C are a perspective view when viewed from front side, a perspective view when viewed from rear side, and a longitudinal cross-sectional view of a vehicle lighting unit.
Figure 16C:
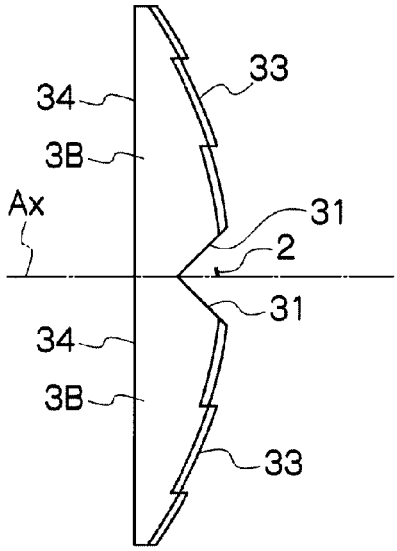
Figure 16B:
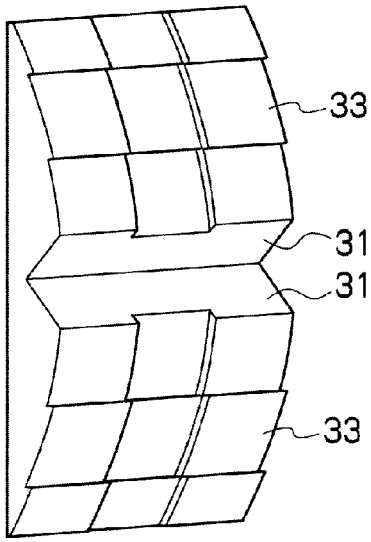

In the modification 2, the vehicle lighting unit 1B includes the single light guide 3B, but the presently disclosed subject matter is not limited to this mode. For example, as shown in FIGS. 16A to 16C, two light guides 3B can be arranged with symmetry in the vertical direction, and the light source 12 can be disposed along the optical axis Ax to form the vehicle lighting unit 1C.

<Modification 3>

Next, a description will be given of a modification 3 of the present exemplary embodiment.

FIGS. 17A, 17B, 17C, and 17D are a perspective view when viewed from a front side, a longitudinal cross-sectional view, and a perspective view when viewed from a rear side of a vehicle lighting unit 1D (or modification 3), and a comparative example, respectively.

The vehicle lighting unit 1D of the modification 3 can be configured in the same manner as in the modification 2, except that the light incident surface 31 of the light guide 3C can receive the light and the light source 2 can be disposed to face to the light incident surface 31 so that the light can be internally reflected off a reflection surface 33D corresponding to the second reflection surface 33 and exit through the light exiting surface 34, namely, except that the unit 1D does not include the first reflection surface 32 and the internal reflection is performed once within the light guide 3C by the reflection surface 33D.

Specifically, the light guide 3C can be a solid light guiding lens including the light incident surface 31, the light exiting surface 34, and the reflection surface 33D opposed to the light exiting surface 34 and inclined thereto, so that the light entering through the light incident surface 31 can be internally reflected off the reflection surface 33D and then exit through the light exiting surface 34.

Figure 17A:
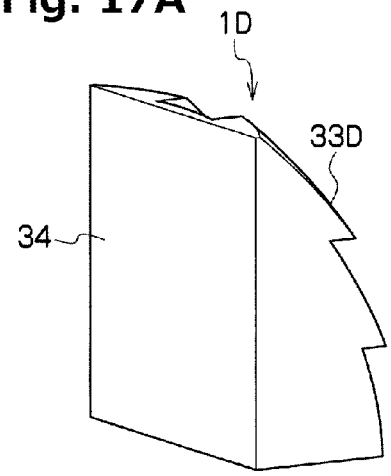
FIGS. 17A, 17B, 17C, and 17D are a perspective view when viewed from a front side, a longitudinal cross-sectional view, and a perspective view when viewed from a rear side of a vehicle lighting unit (or modification 3), and a comparative example.
Figure 17C:
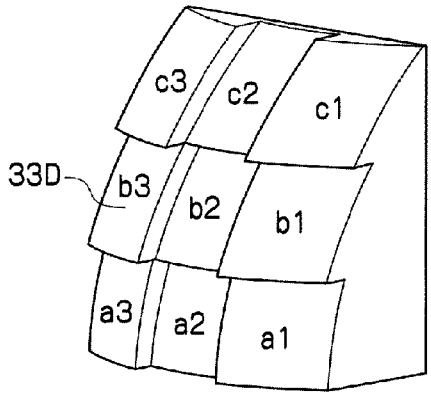

The reflection surface 33D can include a plurality of reflection regions a1 to a3, b1 to b3, and c1 to c3 divided by two horizontal planes and two vertical planes parallel to the optical axis Ax as shown in FIG. 17C.

Figure 17B:
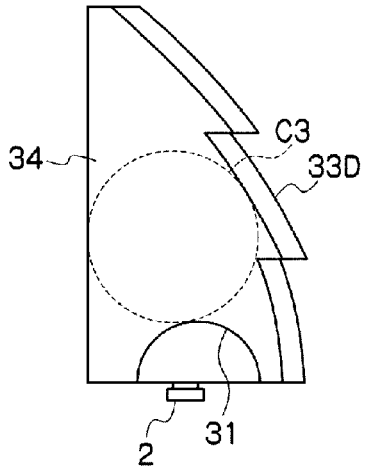
Figure 17D:
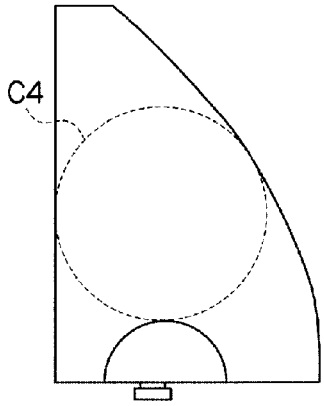

With reference to FIGS. 17B and 17D, the maximum inscribed circle C3 in FIG. 17B is smaller than the inscribed circle C4 in FIG. 17D, meaning that the thickness of the light guide 3C of the modification 3 is thinner than the light guide with the continuous surface. (The maximum thickness portion of the modification 3 is thinner than that of the above exemplary embodiment.)

In the modification 3, the same advantageous effects can be obtained as in the modification 2.

It will be apparent to those skilled in the art that various modifications and variations can be made in the presently disclosed subject matter without departing from the spirit or scope of the presently disclosed subject matter. Thus, it is intended that the presently disclosed subject matter cover the modifications and variations of the presently disclosed subject matter provided they come within the scope of the appended claims and their equivalents. All related art references described above are hereby incorporated in their entirety by reference.

Figure 9A:
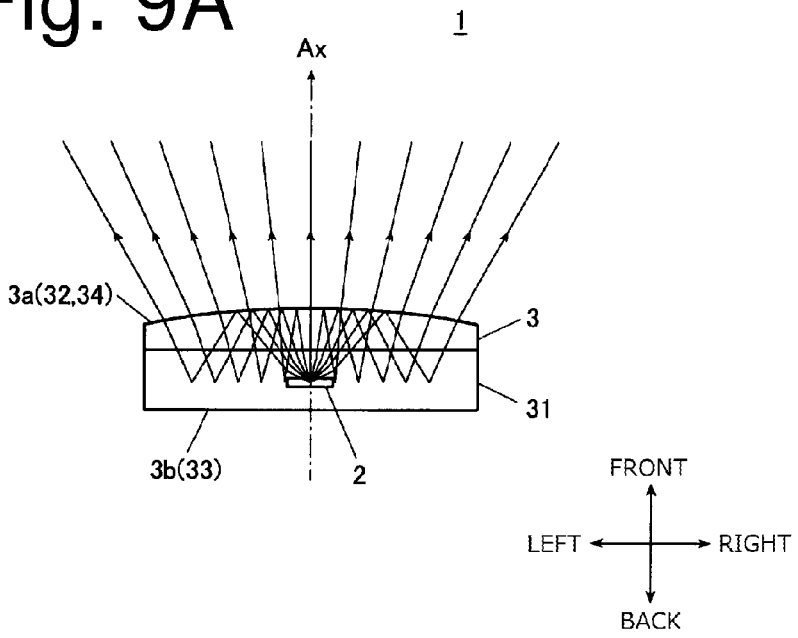
FIGS. 9A and 9B are a plan view of a vehicle lighting unit and a diagram showing a light distribution pattern formed thereby when the front surface of the light guide is convex, respectively.
Figure 9B:
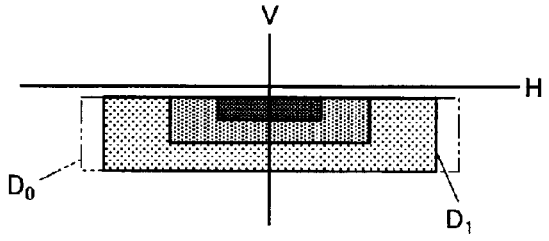
Figure 10A:
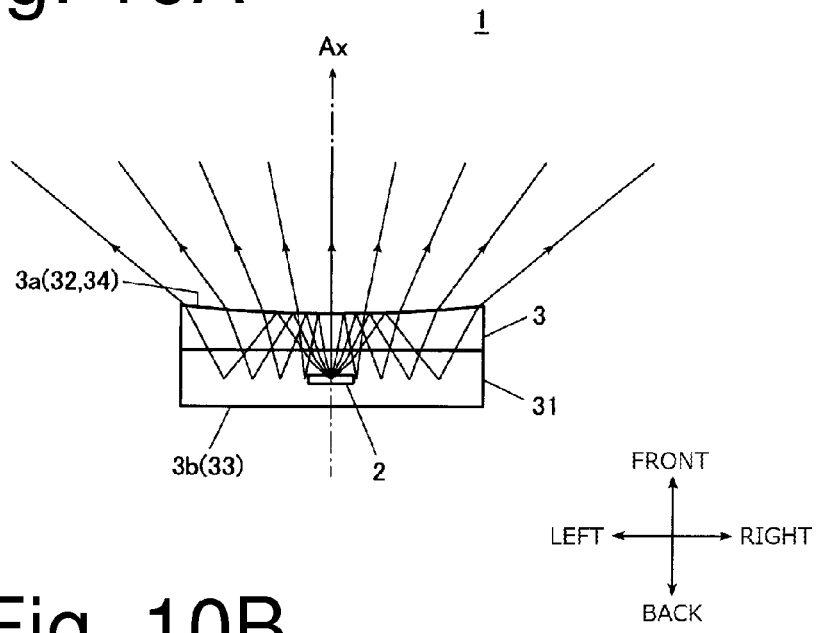
FIGS. 10A and 10B are a plan view of a vehicle lighting unit and a diagram showing a light distribution pattern formed thereby when the front surface of the light guide is concave, respectively.
Figure 10B:
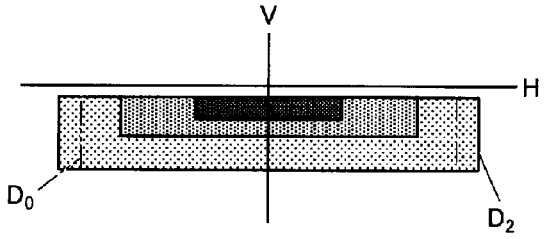

For example, in the above exemplary embodiment and modifications 2 and 3, the front surface 3*a* of the light guide 3 can be a flat surface, but may be an appropriate curved surface in accordance with a desired light distribution pattern. For example, as shown in FIG. 9A, the front surface 3*a* of the light guide 3 can be curved forward (in a convex shape) as in the modification 1, and in this case, as shown in FIG. 9B, a light distribution pattern D1 can be formed horizontally narrower than a light distribution pattern D0 of the light guide with a flat front surface 3*a*. On the other hand, as shown in FIG. 10A, the front surface 3*a* of the light guide 3 can be curved rearward (in a concave shape), and in this case, as shown in FIG. 10B, a light distribution pattern D2 can be formed horizontally wider than the light distribution pattern D0 of the light guide with a flat front surface 3*a*.

Further, in the exemplary embodiment and the respective modifications, the light guide 3, 3A and the like can be disposed forward and obliquely downward with respect to the light source 2, but the presently disclosed subject matter is not limited thereto. For example, the light guide can be disposed forward and obliquely sideward with respect to the light source 2. In this case the other surfaces can be appropriately designed according to the positional relationship.

The first reflection surface 32 and the light exiting surface 34 can be a single surface 3*a* (3*c*), but they can also be formed separately.

Furthermore, the light incident surface 31 of the light guide 3 (3A) can be a curved surface other than a flat surface.

What is claimed is:

1. A vehicle lighting unit having an optical axis, comprising:

a solid light guide having a light exiting surface, a reflection surface opposite to the light exiting surface, and a light incident surface through which light enters the light guide, the light guide configured such that light entering via the light incident surface reaches and is internally reflected off the light exiting surface, then internally reflected off the reflection surface, and exits through the light exiting surface; and an LED light source disposed to face forward and obliquely downward with respect to the optical axis and towards the light incident surface, the light source configured to emit light that enters the light guide through the light incident surface, is internally reflected off the light exiting surface, is internally reflected off the reflection surface, and exits through the light exiting surface as light parallel to the optical axis, wherein the light exiting surface is a continuous surface that is only one of a parabola and a straight line including a region for internally reflecting the light entering through the light incident surface and a region through which the light internally reflected exits as the light parallel to the optical axis.

2. The vehicle lighting unit according to claim 1, wherein the reflection surface is divided into a plurality of reflection regions by at least one horizontal plane.

3. The vehicle lighting unit according to claim 2, wherein the reflection surface is divided into the plurality of reflection regions by at least one vertical plane.

4. The vehicle lighting unit according to claim 1, wherein the reflection surface is divided into a plurality of reflection regions by at least one vertical plane.

5. The vehicle lighting unit according to claim 1, wherein the light exiting surface is a curved surface in a vertical direction and a horizontal direction.

6. A vehicle lighting unit comprising:

a solid light guide having a light exiting surface, a reflection surface opposite to the light exiting surface, and a light incident surface through which light enters the light guide, the light guide configured such that light entering via the light incident surface reaches and is internally reflected off the light exiting surface, then internally reflected off the reflection surface, and exits through the light exiting surface; and an LED light source disposed to face towards the light incident surface, the light source configured to emit light that enters the light guide through the light incident surface, is internally reflected off the light exiting surface, is internally reflected off the reflection surface, and exits through the light exiting surface, wherein the reflection surface includes a plurality of divided reflection regions, the reflection regions include at least one reflection region disposed at a reference position and at least one reflection region disposed at a position closer to the light exiting surface than the reference position, and the light exiting surface is a continuous surface that is only one of a parabola and a straight line including a region for internally reflecting the light entering through the light incident surface and a region through which the light internally reflected exits as the light parallel to the optical axis.

7. The vehicle lighting unit according to claim 6, wherein the reflection surface is divided into the plurality of reflection regions by at least one horizontal plane.

8. The vehicle lighting unit according to claim 7, wherein the reflection surface is divided into the plurality of reflection regions by at least one vertical plane.

9. The vehicle lighting unit according to claim 7, wherein the reflection surface is divided into the plurality of reflection regions by at least two vertical planes, and the reflection regions between the two vertical planes are disposed at positions shifted closer to the light exiting surface than the adjacent reflection regions on both sides.

10. The vehicle lighting unit according to claim 6, wherein the reflection surface is divided into the plurality of reflection regions by at least one vertical plane.

11. The vehicle lighting unit according to claim 10, wherein the reflection surface is divided into the plurality of reflection regions by at least two vertical planes, and the reflection regions between the two vertical planes are disposed at positions shifted closer to the light exiting surface than the adjacent reflection regions on both sides.

12. The vehicle lighting unit according to claim 6, wherein the reflection surface is divided into the plurality of reflection regions by at least two vertical planes, and the reflection regions between the two vertical planes are disposed at positions shifted closer to the light exiting surface than the adjacent reflection regions on both sides.

13. The vehicle lighting unit according to claim 6, wherein the plurality of reflection regions are disposed at a position shifted closer to the light exiting surface as the reflection region is closer to the light incident surface.

14. The vehicle lighting unit according to claim 6, wherein the plurality of reflection regions each form a light distribution pattern part constituting a desired light distribution pattern formed by the light projected through the light exiting surface.

15. The vehicle lighting unit according to claim 6, wherein the light exiting surface is a curved surface in a vertical direction and a horizontal direction.

16. A vehicle lighting unit comprising:

a solid light guide having a light exiting surface, a reflection surface opposite to the light exiting surface, and a light incident surface through which, during operation of the lighting unit, light enters the light guide so that the light reaches and is internally reflected off the reflection surface, and exits through the light exiting surface; and an LED light source disposed to face towards the light incident surface, the light source configured to emit light that enters the light guide through the light incident surface, is internally reflected off the reflection surface, and exits through the light exiting surface, wherein the reflection surface includes a plurality of divided reflection regions, the reflection regions include at least one reflection region disposed at a reference position and at least one reflection region disposed at a position closer to the light exiting surface than the reference position, and the light exiting surface is a continuous surface that is only one of a parabola and a straight line including a region for internally reflecting the light entering through the light incident surface and a region through which the light internally reflected exits as the light parallel to the optical axis.

17. The vehicle lighting unit according to claim 16, wherein the reflection surface is divided into the plurality of reflection regions by at least one horizontal plane.

18. The vehicle lighting unit according to claim 17, wherein the reflection surface is divided into the plurality of reflection regions by at least one vertical plane.

19. The vehicle lighting unit according to claim 17, wherein the reflection surface is divided into the plurality of reflection regions by at least two vertical planes, and the reflection regions between the two vertical planes are disposed at positions shifted closer to the light exiting surface than the adjacent reflection regions on both sides.

20. The vehicle lighting unit according to claim 16, wherein the reflection surface is divided into the plurality of reflection regions by at least one vertical plane.

21. The vehicle lighting unit according to claim 20, wherein the reflection surface is divided into the plurality of reflection regions by at least two vertical planes, and the reflection regions between the two vertical planes are disposed at positions shifted closer to the light exiting surface than the adjacent reflection regions on both sides.

22. The vehicle lighting unit according to claim 16, wherein the reflection surface is divided into the plurality of reflection regions by at least two vertical planes, and the reflection regions between the two vertical planes are disposed at positions shifted closer to the light exiting surface than the adjacent reflection regions on both sides.

23. The vehicle lighting unit according to claim 16, wherein the plurality of reflection regions are disposed at a position shifted closer to the light exiting surface as the reflection region is closer to the light incident surface.

24. The vehicle lighting unit according to claim 16, wherein the plurality of reflection regions each form a light distribution pattern part constituting a desired light distribution pattern formed by the light projected through the light exiting surface.

25. The vehicle lighting unit according to claim 16, wherein the light exiting surface is a curved surface in a vertical direction and a horizontal direction.

* * * * *